US005816938A

United States Patent [19]

Kakiuchi

[11] Patent Number: 5,816,938

[45] Date of Patent: Oct. 6, 1998

[54] GOLF BALL

[75] Inventor: Shinichi Kakiuchi, Chichibu, Japan

[73] Assignee: Bridgestone Sports Co., Ltd., Tokyo, Japan

[21] Appl. No.: 808,435

[22] Filed: Feb. 28, 1997

Related U.S. Application Data

[63] Continuation-in-part of Ser. No. 624,094, Mar. 29, 1996, abandoned.

[30] Foreign Application Priority Data

Apr. 26, 1995 [JP] Japan ..... 7-125965

[51] Int. Cl.[6] ..... A63B 37/08; A63B 37/12

[52] U.S. Cl. ..... 473/354; 473/378; 473/365

[58] Field of Search ..... 473/354, 378, 473/365

[56] References Cited

U.S. PATENT DOCUMENTS 5,511,791 4/1996 Ebisuno et al. ..... 473/354

5,605,512 2/1997 Yamada et al. ..... 473/354

5,655,977 8/1997 Kakiuchi et al. ..... 473/354

5,674,137 10/1997 Maruko et al. ..... 473/354

*Primary Examiner*—George J. Marlo

*Attorney, Agent, or Firm*—Sughrue, Mion, Zinn, Macpeak & Seas, PLLC

[57] ABSTRACT

The invention provides a wound golf ball comprising a liquid center in the form of a center bag filled with a liquid, a thread rubber layer, and a cover. The liquid is based on water and has a viscosity of 1 to 500 centipoises at 20° C. The liquid center has a diameter D of 26–32 mm. The relationship: $(A \times B)/D \leqq 4.5$ is met wherein A is a gage as expressed in mm and B is a hardness on JIS A scale of the center bag. A hysteresis loss of up to 7% is recorded when the liquid center is deformed to 50% of its diameter. The ball has a pleasant hitting feel and a reduced spin rate, and travels a longer distance.

14 Claims, 1 Drawing Sheet

GOLF BALL

CROSS REFERENCE TO RELATED APPLICATION

This application is a continuation-in-part of application Ser. No. 08/624,094 filed on Mar. 29, 1996, the entire contents of which are hereby incorporated by reference. The '094 application is now abandoned.

BACKGROUND OF THE INVENTION

1. Field of the Invention

This invention relates to a thread wound golf ball affording an increased flying distance.

2. Prior Art

In general, thread wound golf balls are manufactured by winding high tension thread rubber on a spherical liquid center to form a thread rubber layer thereon and enclosing the thread rubber layer with a cover of balata rubber or ionomer resin. Most often, the liquid center is a hollow spherical center bag of rubber filled with a liquid, typically water containing a specific gravity adjusting agent.

Major requirements for golf balls include flight distance and ease of ball control. As compared with two-piece golf balls, wound golf balls have the advantages of an increased back spin, ease of control, and pleasant feel, but undesirably travel less distances because they tend to climb up due to back spin.

It was desired in the prior art to develop a wound golf ball capable of traveling a longer flying distance. A number of proposals were made to achieve such improvement, for example, by modifying the liquid center for reducing a spin rate as disclosed in Japanese Patent Application Kokai (JP-A) Nos. 168471/1985, 181070/1987, and 255162/1990, enlarging the liquid center to a diameter of 29.5 to 32 mm and providing a total dimple volume of 280 to 340 mm as disclosed in JP-A 304269/1994, and specifying the composition of a liquid to be filled in a center bag as disclosed in Japanese Patent Application No. 126923/1994. These modified wound golf balls are successful in increasing flight distance to some extent although a further increase of flight distance is desired.

SUMMARY OF THE INVENTION

An object of the present invention is to provide a wound golf ball which is improved in flight distance without sacrificing its own advantages including ease of control and pleasant hitting feel.

In order to reduce the spin rate of a wound golf ball to increase its flying distance, the inventors attempted to reduce the hardness of a liquid center and increase the diameter thereof while investigating their relationship. We have found that a liquid center of optimum softness and restitution is obtained when a liquid to be filled in a center bag is based on water and has a viscosity of 1 to 500 centipoises at 20° C. When that the liquid center has a diameter D as expressed in mm and the center bag has a gage A as expressed in mm and a hardness B on JIS A scale, D, A, and B fall in a specific range, the liquid center diameter D is 26 to 32 mm and D, A and B meet the relationship: $(A\times B)/D\leqq 4.5$, and the liquid center experiences a hysteresis loss of up to 7% upon deformation of the liquid center to 50% of its diameter D. Quite unexpectedly, a wound golf ball using this liquid center spins less upon hitting because of greater deformation and thus travels a longer flying distance without detracting from the advantages of wound golf balls including ease of control, and has a pleasant hitting feel and sound for professional golfers.

Briefly stated, the present invention provides a wound golf ball comprising a liquid center in the form of a center bag filled with a liquid, a thread rubber layer, and a cover. The liquid is based on water and has a viscosity of 1 to 500 centipoises at 20° C. The liquid center has a diameter D of 26 to 32 mm and the center bag has a thickness A as expressed in mm and a hardness B as measured on JIS A scale in a relationship: $(A\times B)/D\leqq 4.5$. The liquid center experiences a hysteresis loss of up to 7% when the liquid center is deformed to 50% of its diameter D.

BRIEF DESCRIPTION OF THE DRAWINGS

The sole figure.

DETAILED DESCRIPTION OF THE INVENTION

Figure 1:
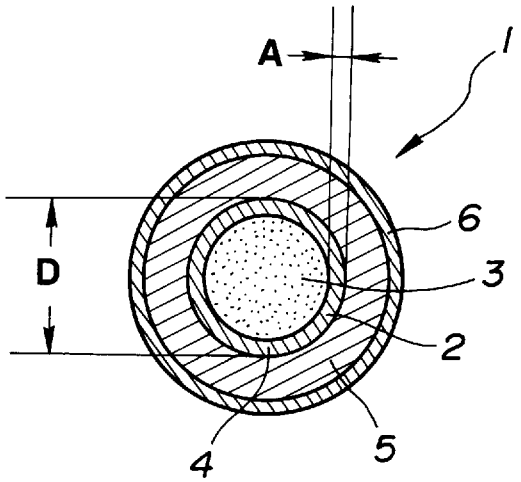
FIG. 1 is a schematic cross-sectional view of a wound golf ball according to one embodiment of the invention.

Referring to FIG. 1, a wound golf ball generally designated at 1 according to the invention is illustrated as comprising a liquid center 4 in the form of a center bag 2 filled with a liquid 3, a thread rubber layer 5, and a cover 6. In FIG. 1, letter D shows a diameter of the liquid center and letter A shows the thickness of the center bag.

The liquid center 4 consists of the center bag 2 and the fill liquid 3. For the purpose of increasing the flying distance, the present invention modifies the composition of a center bag to control optimum hardness and thickness of the center bag and the softness and restitution of the liquid center. More specifically, the liquid center has a diameter D of 26 to 32 mm and the center bag has a thickness A as expressed in mm and a hardness B as measured on JIS A scale in a relationship: $(A\times B)/D\leqq 4.5$. The liquid center experiences a hysteresis loss of up to 7% when the liquid center is deformed to 50% of its diameter D. The hardness on JIS A scale is the value measured by spring type hardness test using Type A of the spring type hardness tester according to JIS K 630-11975.

The liquid center of the wound golf ball of the invention has a diameter D of 26 to 32 mm, preferably 28 to 31 mm. A center diameter of less than 26 mm is ineffective for reducing spin whereas a center diameter of more than 32 mm fails to provide an adequate ball hardness. The center diameter D, center bag gage A and center bag hardness B are related such that the value of $(A\times B)/D$ is up to 4.5, preferably from 2.0 to 4.5, more preferably from 2.0 to 4.0. The benefits of the invention are more or less lost with $(A\times B)/D>4.5$. The relationship $(A\times B)/D$ suggests that the liquid center is better as the center bag thickness A and center bag hardness B are reduced and the center diameter D is increased. A wound golf ball using this liquid center undergoes greater deformation and thus receives less spin upon hitting. The center bag preferably has a thickness A of 1.5 to 3.0 mm, especially 1.8 to 2.5 mm and a hardness B of 40 to 60, especially 45 to 55 on JIS A scale.

The center bag may be formed from a composition of well-known components, for example, a rubber component such as natural rubber, butadiene rubber, isoprene rubber and mixtures thereof, an inorganic filler for specific gravity adjustment such as zinc white, a vulcanizing agent such as sulfur, a vulcanization promoter, process oil, crosslinking agent and stearic acid. The center bag may be formed by well-known methods.

The center bag is filled with a liquid to form a liquid center. The liquid is based on water. If required, a water-soluble inorganic compound such as sodium sulfate ($Na_2SO_4$), aluminum chloride ($AlCl_3$), barium chloride ($BaCl_2$), calcium chloride ($CaCl_2$), copper sulfate ($CuSO_4$), ferrous sulfate ($FeSO_4$), potassium chloride (KCl), potassium nitride ($KNO_3$), magnesium chloride (MgCl) may be added in an amount of 1 to 46 parts by weight, preferably 5 to 30 parts by weight, more preferably 8 to 22 parts by weight per 100 parts by weight of water.

The liquid has a viscosity of 1 to 500 centipoises, preferably 1 to 200 centipoises at 20° C. It should be noted that the value of the viscosity is a value measured by B-type viscometer.

The other additives including glycerin and ethylene glycol may be added so long as the viscosity of the liquid is maintained in the range defined above.

The fill liquid preferably has a specific gravity of 1.0 to 1.5, especially 1.1 to 1.2.

According to the invention, the liquid center is formed by filling a center bag with a liquid as mentioned above such that the liquid center may experience a hysteresis loss of up to 7%, preferably 3 to 5% when the liquid center is deformed to 50% of its diameter D. A liquid center with a hysteresis loss of more than 7% is low in restitution and some benefits of the invention are lost. The term "hysteresis loss" used herein is a percent loss upon recovery after a liquid center is deformed under a load. It is a measure of the restitution of the liquid center.

The liquid center meeting the above-mentioned requirements has satisfactory softness and restitution (or repulsion).

The thread rubber layer 5 is formed by winding thread rubber on the liquid center 4 under high tension. Any well-known thread rubber commonly used in wound golf balls may be used to form the thread rubber layer. Winding thread rubber on the liquid center gives a wound core which preferably has an outer diameter of 38 to 41 mm, especially 39 to 40.5 mm.

The thus obtained wound core is enclosed with the cover 6 to complete the wound golf ball of the invention. Any of well-known cover materials may be used. Cover materials based on balata rubber and ionomer resins are useful. The cover preferably has a radial thickness of 1.0 to 2.5 mm, especially 1.2 to 2.0 mm and a hardness of 70 to 93 on JIS C scale measured by using Type C of the spring type hardness tester according to JIS K 6301-1975.

The cover may be a single layer or consist of multiple layers. In the multilayer cover, the thickness of the respective layers depends on particular conditions under which they are formed and may be selected without undue experimentation. Any conventional technique may be used for forming the cover around the wound core. For example, a cover is formed by placing the wound core in a mold and injection molding a cover-forming resin composition around the core. Alternatively, a cover is formed by preforming a pair of hemi-spherical half cups from a cover-forming resin composition and enclosing the wound core with the pair of half cups, followed by thermo-compression molding.

In this way, there is obtained a wound golf ball. At the same time when or after the wound core is enclosed with the cover, the cover is formed with dimples. The dimples may have any desired geometry distribution such as octahedral, eicosahedral and other polyhedral distribution, and any desired model such as square, hexagon, pentagon, and triangle models.

The wound golf ball thus completed should have a diameter and weight complying with the Rules of Golf, namely a diameter of at least 42.67 mm and a weight of up to 45.93 grams. From the standpoints of hitting feel, restitution and durability, the ball preferably has such a hardness that its distortion under a load of 100 kg is 2.6 to 3.6 mm.

There has been described a wound golf ball which is improved in flying distance by reducing spin without sacrificing its own advantages.

EXAMPLE

Examples of the present invention are given below by way of illustration and not by way of limitation.

Examples 1–3 & Comparative Examples 1–3

A liquid center was prepared as follows. A center bag was prepared from the composition shown in Table 1 to the viscosity, specific gravity, hardness and gage shown in Table 1. The center bag was filled with a fill liquid to form a liquid center. More particularly, Examples 1 to 3 used a 20 wt% sodium sulfate aqueous solution and Comparative Examples 1 and 2 used only water as the fill liquid. Comparative Example 3 used a barium sulfate paste as the fill liquid. The barium sulfate paste was prepared according to the following formulation.

| Components | Parts by weight |
|---|---|
| Barium sulfate | 100 |
| Sodium carboxymethyl cellulose | 6 |
| Dodecylbenzenesulfonate acid | 4 |
| Water | 30 |

The center bag was filled with an amount of the fill liquid as shown in Table 1, obtaining a liquid center. The weight and outer diameter of the liquid center are also reported in Table 1.

Wound golf balls of Examples 1–3 and Comparative Examples 1–3 were prepared by forming on the liquid center a layer of thread rubber and a cover of the following compositions.

| | Parts by weight |
|---|---|
| Thread rubber composition | |
| Polyisoprene rubber | 70 |
| Natural rubber | 30 |
| Zinc white | 1.5 |
| Stearic acid | 1.0 |
| Vulcanizing promoter + Sulfur | 2.6 |
| Balata cover composition | |
| Synthetic trans-polyisoprene rubber | 80 |
| High-impact styrene resin | 10 |
| Natural rubber | 10 |
| Zinc white | 10 |
| Titanium oxide | 10 |
| Stearic acid | 1.0 |
| Vulcanizing promoter + Sulfur | 1.5 |

The wound golf balls thus obtained were examined for (A×B)/D, hysteresis loss after 50% deformation, ball hardness, and flying performance. The results are shown in Table 1. It is noted that (A×B)/D is (center bag thickness ×center bag hardness)/liquid center diameter as previously defined. The hysteresis loss after 50% deformation, ball hardness, flying performance, and feel were measured and evaluated by the following tests.

Hysteresis loss after 50% deformation

Using an Instron compression tester, the liquid center was compressed at a rate of 50 mm/min. to 50% of the center diameter and then allowed to resume the original position. A hysteresis loss was calculated from a load-deformation area X upon compression and a load-deformation area Y upon restoration.

Hysteresis loss=(X−Y)/X×100%

Ball hardness

Hardness is expressed by a distortion (mm) of a ball under a load of 100 kg.

Flying test

Using a swing robot, a sample ball was hit by a driver (W#1) at a head speed (HS) of 45 m/s to measure a carry and a total flying distance. Under this hitting condition, an initial velocity, spin and elevation angle were measured.

Feel

Three professional golfers evaluated a feel on impact using #W1. The ball was rated "○" for a soft feel, "Δ" for a somewhat hard feel, and "X" for a hard feel.

TABLE 1

| | Example | | | Comparative Example | | |
|---|---|---|---|---|---|---|
| | 1 | 2 | 3 | 1 | 2 | 3 |
| Center bag Composition | | | | | | |
| Natural rubber | 100 | 100 | 100 | 100 | 100 | 100 |
| Zinc white | 185 | 145 | 145 | 330 | 265 | 40 |
| Process oil | 25 | 25 | 25 | 30 | 25 | — |
| Stearic acid | 1.0 | 1.0 | 1.0 | 1.0 | 1.0 | 1.0 |
| VP + S | 4.0 | 4.0 | 4.0 | 4.0 | 4.0 | 4.0 |
| Specific gravity | 1.82 | 1.66 | 1.66 | 2.33 | 2.13 | 1.22 |
| Hardness, JIS A | 54 | 55 | 55 | 61 | 58 | 52 |
| Thickness, mm | 2.3 | 2.3 | 2.3 | 2.2 | 2.3 | 2.8 |
| Fill liquid | | | | | | |
| Component | Sodium sulfate* | Sodium sulfate* | Sodium sulfate* | Water | Water | Barium sulfate paste** |
| Volume, $cm^3$ | 7.7 | 8.7 | 9.9 | 7.0 | 7.7 | 6.7 |
| Paste amount, g | — | — | — | — | — | 6.4 |
| Viscosity, cp*** | 1 | 1 | 1 | 1 | 1 | 30000 |
| Specific gravity | 1.19 | 1.19 | 1.19 | 1.00 | 1.00 | 1.54 |
| Liquid center | | | | | | |
| Weight, g | 17.9 | 19.7 | 21.5 | 16.6 | 17.8 | 17.7 |
| Diameter, mm | 29 | 30 | 31 | 28 | 29 | 29 |
| (A × B)/D | 4.28 | 4.22 | 4.08 | 4.79 | 4.60 | 5.02 |
| Hysteresis loss | 3.4 | 3.5 | 3.6 | 9.5 | 7.8 | 3.8 |
| Ball | | | | | | |
| Weight, g | 45.2 | 45.3 | 45.4 | 45.2 | 45.3 | 45.2 |
| Diameter, mm | 42.67 | 42.68 | 42.67 | 42.67 | 42.68 | 42.68 |
| Hardness, mm | 2.90 | 2.80 | 2.84 | 2.81 | 2.82 | 2.85 |
| Flying test (W#1, HS = 45 m/s) | | | | | | |
| Spin (rpm) | 3250 | 3180 | 3090 | 3350 | 3270 | 3300 |
| Initial velocity (m/s) | 65.5 | 65.4 | 65.5 | 65.0 | 65.0 | 65.2 |
| Elevation angle (°) | 12.2 | 12.1 | 12.2 | 12.2 | 12.2 | 12.2 |
| Carry (m) | 207.9 | 207.5 | 206.6 | 205.2 | 206.0 | 205.0 |
| Total (m) | 217.9 | 218.3 | 219.0 | 215.0 | 216.2 | 215.2 |
| Feel | O | O | O | O | O | X |

*20 wt% sodium sulfate aqueous solution

**Barium sulfate paste was diluted with water so that the liquid had a specific gravity of 1.54.

***measured by using B type viscometer "DVL-B II" manufactured by Toki Sangyo K.K.

As is evident from Table 1, the wound golf balls of the invention (Examples 1 to 3) have a pleasant hitting feel and a reduced spin rate, and travel a longer distance.

On the other hand, the wound golf balls of Comparative Examples 1–3 travel a less distance. Comparative Example 3 using a barium sulfate paste as the fill liquid has a hard feel.

Although some preferred embodiments have been described, many modifications and variations may be made thereto in the light of the above teachings. It is therefore to be understood that within the scope of the appended claims, the invention may be practiced otherwise than as specifically described.

I claim:

1. A wound golf ball comprising; a liquid center in the form of a center bag filled with a liquid, a wound thread rubber layer radially outside said liquid center bag, and a cover, wherein said center bag is formed from a composition comprising a rubber component, an inorganic filler, sulfur and a vulcanization promoter, said liquid is mainly composed of water and a water-soluble inorganic compound, and has a viscosity of 1 to 500 centipoises at 20° C., said liquid center has a diameter D of 26 to 32 mm and said center bag has a thickness A as expressed in mm and a hardness B as measured on JIS A scale in a relationship: $(A \times B)/D \leqq 4.5$, and said liquid center experiences a hysteresis loss of up to 7% when said liquid center is deformed to 50% of its diameter D.

2. The wound golf ball of claim 1 wherein said center bag has a thickness A of 1.5 to 3.0 mm.

3. The wound golf ball of claim 1 wherein said center bag has a hardness B of 40 to 60 on JIS A scale.

4. The wound golf ball of claim 1 wherein $2.0 \leqq (A \times B)/D \leqq 4.5$.

5. The wound golf ball of claim 1 wherein the hysteresis loss is 3 to 5%.

6. The wound golf ball of claim 1 wherein the liquid has a specific gravity of 1.0 to 1.5.

7. The wound golf ball of claim 1 wherein the water-soluble inorganic acid is at least one selected from the group consisting of sodium sulfate, aluminum chloride, barium chloride, calcium chloride, copper sulfate, ferrous sulfate, potassium chloride, potassium nitride and magnesium chloride.

8. The wound golf ball of claim 1 wherein said center bag has a hardness in the range of 45 to 55 on JIS A scale.

9. The wound golf ball of claim 1 wherein said liquid has a viscosity in the range of 1 to 200 centipoises at 20° C.

10. The wound golf ball of claim 1 wherein said liquid has a specific gravity in the range of 1.1 to 1.2.

11. The wound golf ball of claim 1 wherein a wound thread rubber core formed over said center bag has an outer diameter in the range of 35 to 41 mm.

12. The wound golf ball of claim 1 wherein said cover has a radial thickness in the range of 1.0 to 2.5 mm.

13. The wound golf ball of claim 1 wherein said cover has a hardness in the range of 70 to 13 on JIS C.

14. The wound golf ball of claim 1 wherein said ball has a distortion under a load of 100 kg in the range of 2.6 to 3.6 mm.

* * * * *